US005785283A

United States Patent [19]

Ehrenberger et al.

[11] Patent Number: 5,785,283

[45] Date of Patent: Jul. 28, 1998

[54] SYSTEM AND METHOD FOR COMMUNICATING OPERATIONAL STATUS OF A RAILWAY WAYSIDE TO A LOCOMOTIVE CAB

[75] Inventors: Michael J. Ehrenberger, Pittsburgh, Pa.; Randall S. Mecca, Columbia, S.C.; Kenneth Gottschlich; Christopher R. Harper, both of Pittsburgh, Pa.; Jack L Wilson, Overland Park, Kans.

[73] Assignee: Union Switch & Signal Inc., Pittsburgh, Pa.

[21] Appl. No.: 756,322

[22] Filed: Nov. 25, 1996

[51] Int. Cl.[6] ..... B61L 23/00

[52] U.S. Cl. ..... 246/62; 246/121; 246/167 R; 246/178; 340/904

[58] Field of Search ..... 246/28 R, 62, 246/120, 121, 167 R, 169 R, 177, 178, 180; 364/424.03, 424.04; 340/904

[56] References Cited

U.S. PATENT DOCUMENTS

| | | | |
|---|---|---|---|
| 3,601,602 | 8/1971 | Smith | 246/124 |
| 3,984,807 | 10/1976 | Haemming | 340/23 |
| 4,083,003 | 4/1978 | Haemmig | 325/6 |
| 4,735,384 | 4/1988 | Elliott | 246/167 D |
| 5,092,544 | 3/1992 | Petit et al. | 246/126 |
| 5,098,044 | 3/1992 | Petit et al. | 246/187 |
| 5,398,894 | 3/1995 | Pascoe | 246/28 |
| 5,415,369 | 5/1995 | Hungate | 246/167 R |
| 5,533,695 | 7/1996 | Heggestad et al. | 246/62 |

OTHER PUBLICATIONS

Association of American Railroads Communication Manual, "Recommended Guidelines, Considerations and Radio Frequency Requirements For Train Information Systems Reaffirmed in 1994", 1994, part 12–15, Option 14—Hot Box, Dragging Equipment and Other Defects Cab Display, pp. 31–36.

"Monitoring Cabooseless Trains", *Railway Age*, Mar. 1987, pp. 47–48.

*Primary Examiner*—S. Joseph Morano

*Attorney, Agent, or Firm*—Kevin A. Sembrat

[57] ABSTRACT

A system and method of communicating via digital radio between a train and a device positioned at the wayside of a railway system, wherein the device detects defects at the wayside and information related to the defects is transmitted from the wayside to the train for display in the locomotive cab. A communications unit having a microprocessor control circuit and a transceiver is electrically coupled, preferably by serial connection, to the defect detector along the wayside. The transceiver of the communications unit is in radio communication with an existing transceiver in the head-of-train (HOT) unit located in the locomotive cab at the head-end of the train. The head-of-train unit has a microprocessor control circuit that drives a display which is preferably alphanumeric, for the purpose of displaying messages related to the defects detected by the defect detector at the wayside, and subsequently transmitted between the transceiver of the communications unit and the transceiver of the HOT unit. In a preferred embodiment, the HOT unit includes recording apparatus for recording the messages displayed and an alarm for notifying an operator that a message is being displayed.

77 Claims, 4 Drawing Sheets

SYSTEM AND METHOD FOR COMMUNICATING OPERATIONAL STATUS OF A RAILWAY WAYSIDE TO A LOCOMOTIVE CAB

BACKGROUND OF THE INVENTION

1. Field of the Invention

The present invention relates generally to communications systems in the railway industry, and more particularly, to a system and method for communicating operational status information, such as a defect sensed by a wayside device, for display in the locomotive cab.

2. Description of the Related Art

In the related art, wayside systems are located along the track through the North American rail system. A wayside system may be defined as, for instance, a hot box detector, a hot wheel detector, a dragging equipment detector, a high water detector, a high/wide load detector, an automatic equipment identification system, a highway crossing system, an interlocking controller system, or any other equipment located adjacent the track and used to monitor the status of the track, environment and railway vehicles. These wayside systems are typically placed at approximately twenty mile intervals throughout the entire North American rail system. These wayside systems typically communicate operational status information relating to the condition of the train or the track to control centers through various types of modems. In addition, these wayside systems typically communicate similar operational status information in the form of synthesized voice to the train crew in the locomotive cab via voice channel Very-High Frequency (VHF) radio. In the related art, the information has been communicated via voice channel VHF radio because adequate display systems in the locomotive cab have been unavailable. Since the wayside systems "talk" to train crews using VHF radios (typically 5 watts) on the road channel, a great deal of radio congestion is created. This radio congestion can result in a message being transmitted well after a train has passed the detector location, or the message being "walked on", thereby causing the train crew to not hear the message. In either case, the train crew may claim that a message to stop a train was not transmitted or received. This problem is very serious, especially when a train derails after the wayside system determines that a defect exists at the wayside or the train and then sends a stop message that the train does not respond to in a timely manner.

Not all messages transmitted from the wayside system to the train crew via voice channel VHF radio contain information concerning defective equipment. In fact, the majority of messages typically indicate that all systems are working correctly. However, the messages that indicate everything is working correctly contributes more to the problem of radio congestion than the minority of messages that contain defects. With more information being made available at the wayside locations, more information is required either in the cab, or at the control center. As additional information is transmitted, the problem of radio congestion increases. Further, messages from one wayside system may be received by a second train that is different than a first train for which the message was intended, thereby further increasing radio congestion.

Referring now to FIG. 1, there is shown a block diagram of a wayside system 100 in voice radio communication with a locomotive cab 103 in accordance with the prior art. The wayside system 100 receives inputs relating to operational status information associated with the train and track wayside. For instance, the wayside system 100 typically receives a track circuit input 110, a hot box detector (HBD) input 112, a hot wheel detector (HWD) input 114, a dragging equipment detector (DED) input 116, a high wide load detector (HWLD) input 118 and an automatic equipment identification (AEI) input 120.

In addition, as is known in the art, the wayside system 100 may also receive wayside specific information 122 which comprises various inputs related to environmental and other conditions found at the specific wayside of the wayside system 100. For instance, the wayside specific information 122 may include inputs related to wind speed, temperature, slipped earth, or flood conditions.

The wayside system 100 communicates operational status information related to the inputs 110, 112, 114, 116, 118, 120, and 122 to a control center (not shown) through a data modem 124. In addition, a voice radio 126 typically is used as is known in the art to transmit synthesized voice messages relating to the inputs 110, 112, 114, 116, 118, 120, and 122 to be received by a voice radio 130 located in the locomotive cab 103.

As is known in the art, the locomotive cab 103 typically also includes a head-of-train (HOT) unit 132 that communicates with an end-of-train (EOT) unit (not shown), typically using Ultra-High Frequency (UHF) radio, as part of an end-of-train monitoring system (not shown) that is used as a means of eliminating the need for a caboose (not shown). The HOT unit 132 typically includes a microprocessor control circuit 140, a non-volatile memory 142 which stores the control program for the microprocessor control circuit, and a human interface 144 through which an operator stationed at the HOT unit 132 can manually enter the unique code number of the end of train (EOT) unit (not shown) with which the HOT unit 132 communicates via transceiver 146, typically using UHF radio. In addition to inputs from the non-volatile memory 142 and the human interface 144, the microprocessor control circuit 140 typically also has a communication test (COMTEST) switch input 148 and provides outputs to the transceiver 146, a display 150, and an audible alarm 152. In a preferred embodiment, the HOT unit 132 records events displayed with an event data recorder 154 positioned at the locomotive cab 103, as is known in the art.

One solution to decreasing voice channel VHF radio congestion includes transmitting information obtained at the wayside detector to the dispatch center using a communication radio system such as ARES. This radio system was developed by Rockwell International, Inc. for controlling wayside devices from the dispatch center and for tracking the locomotive. After the dispatch center receives the information transmitted from the wayside system, the dispatch center would then transmit the message to the train crew. However, this solution adds an additional step between wayside and the locomotive cab, whereby additional time is used and additional errors could occur. In addition, this solution does not address the problem of the train crew not being able to hear a synthesized voice transmission of the message.

It is known from "Monitoring Cabooseless Trains" in *Railway Age*, March 1987, pp. 47–48, that the ATS&F (Santa Fe) Railroad worked with Colt Technology Corp. to develop a system specifically for displaying and printing train defect information in the locomotive. However, this system has been abandoned.

Consequently, a need exists for a system and method of communicating operational status information, including defects sensed by a wayside system, for display in the locomotive cab, wherein communication of the information using voice channel VHF radio may be eliminated, and wherein the communicated information may be acknowledged at the locomotive cab and recorded for subsequent review and analysis.

SUMMARY OF THE INVENTION

It is therefore an object of the present invention to provide a system and method for communicating operational status information, including defects sensed by a wayside system, for display in the locomotive cab, that eliminates the use of voice channel VHF radio.

It is a feature of the present invention to provide a wayside communications unit that receives electronic input from the wayside system and then transmits digital information from a first transceiver located at the wayside communications unit, to be received by a second transceiver that is typically used for UHF communication between the HOT unit located at the locomotive cab and the EOT unit located at the end of the train.

It is a feature of the present invention to display a message related to status information received from the first transceiver located at the wayside system by the second transceiver for the HOT unit located at the locomotive cab, using an alphanumeric display for the HOT unit.

It is a feature of the present invention to retain the message related to status information for alphanumeric display at the locomotive cab for convenient reference.

It is a further feature of the present invention to transmit an acknowledgment message from the locomotive cab to the wayside communications unit after the operator's acknowledgment at the locomotive cab.

A preferred embodiment of the present invention is a wayside communications unit having a first microprocessor control circuit and a transceiver with related circuitry for transmitting and receiving digital information. The wayside communications unit is electrically coupled to the wayside defect detector, preferably with a serial connection, thereby to receive information relating to defects detected by the wayside defect detector. The information is processed and formatted according to a preferred protocol for transmission by the transceiver in order to be received by a second transceiver located in the head of train (HOT) unit.

Briefly described according to another embodiment of the present invention, a communication system is provided for communicating between a first railway apparatus positioned at a railway wayside location and a second railway apparatus positioned at a second location which is different than the railway wayside location, wherein the communication system comprises: a wayside system positioned at the railway wayside location for sensing a wayside condition and determining an operational status output signal that characterizes the wayside condition; a first communications unit positioned at the wayside system and electrically coupled to the wayside system for generating a digital transmission signal that is responsive to the operational status output signal, the first communications unit comprising first microprocessor means for controlling the first communications unit, and transmitting means for transmitting the digital transmission signal; and a second communications unit positioned at the second location, the second communications unit comprising first microprocessor means for controlling the second communications unit, receiving means in communication with the transmitting means, for receiving the digital transmission signal from the transmitting means, and display means for displaying a message that is responsive to the digital transmission signal.

An advantage of the present invention is that radio congestion on the voice channel VHF radio is avoided.

An additional advantage of the present invention is that communication via voice channel VHF radio is avoided, thereby decreasing potential interference to other wayside systems that use the same voice channel.

Another advantage of the present invention is that the message is continuously displayed or available for display until acknowledged, thereby minimizing the possibility of an operator not receiving the message.

Another advantage of the present invention is that the message may be re-transmitted from the wayside until acknowledged at the appropriate train for which the message was intended, thereby minimizing loss of the message due to radio interference.

Another advantage of the present invention is that the message may be transmitted economically to an already existing locomotive transceiver.

An additional advantage of the present invention is that the digital information relating to the operational status input and the operator's knowledge thereof may be recorded for later review.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
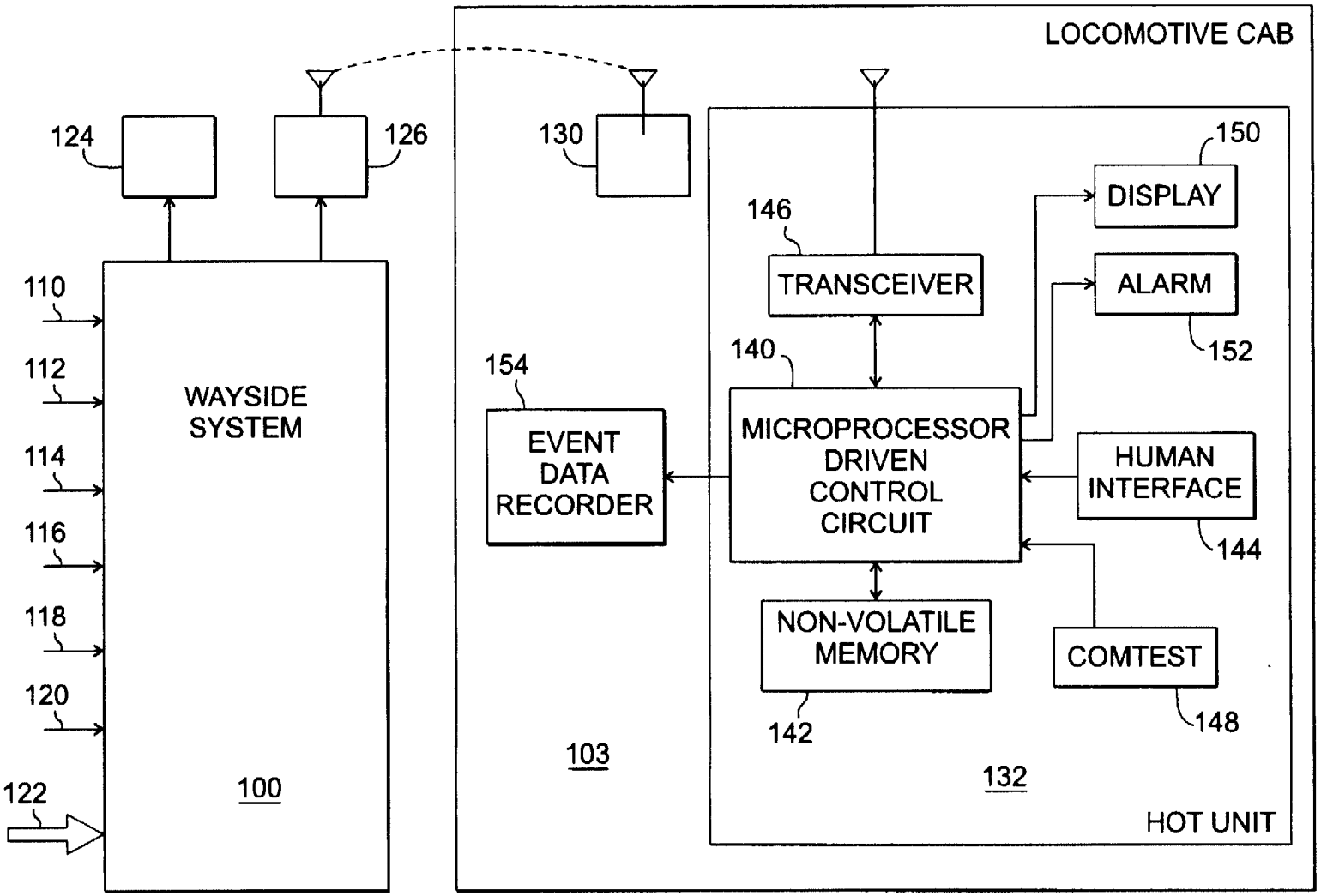
Fig. 1 (Prior Art)
FIG. 1 is a block diagram showing the major component parts of a wayside defect detector and associated head of train unit that uses voice radio communication in accordance with the prior art.
Figure 2:
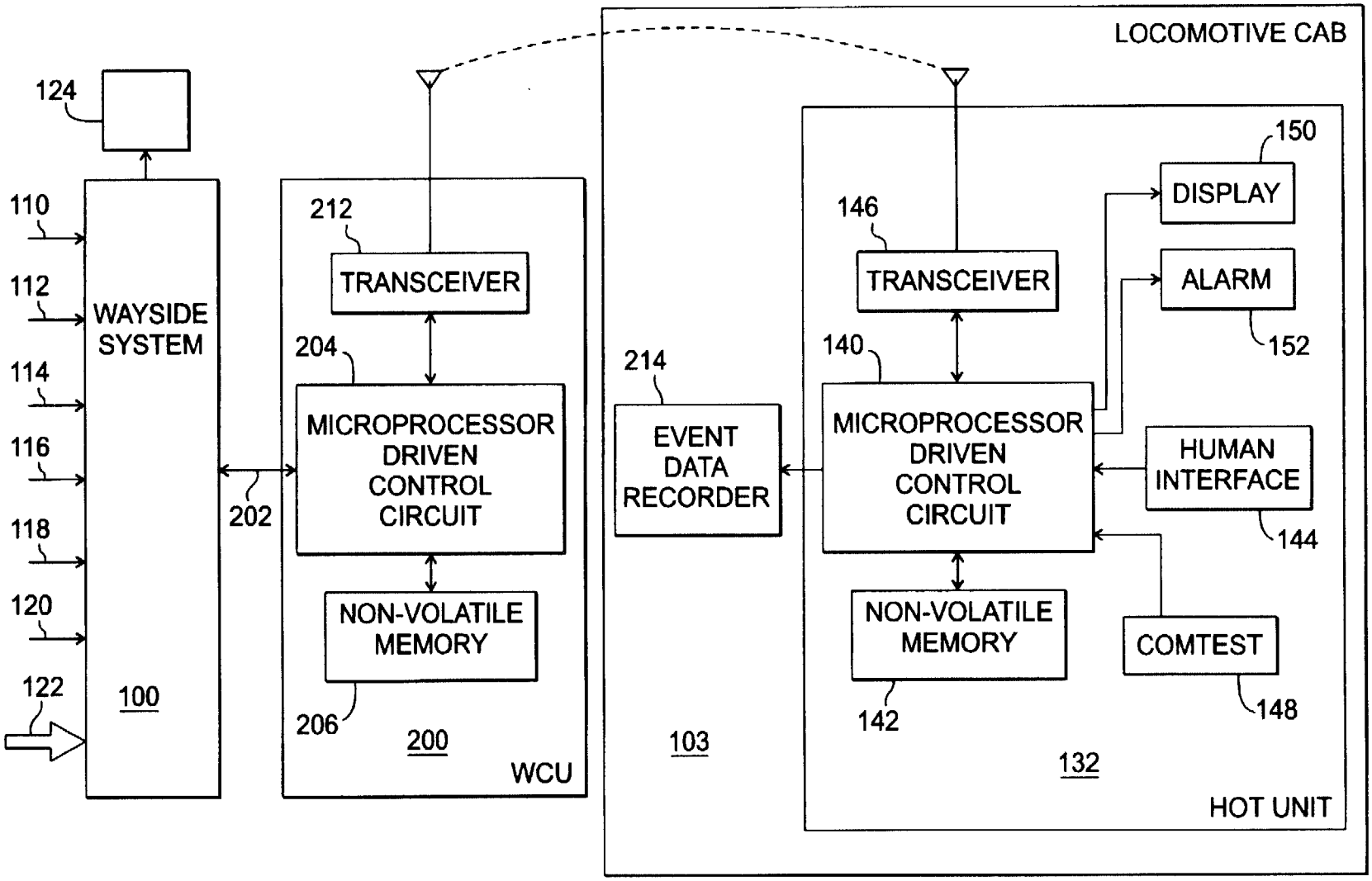
FIG. 2 is a block diagram showing the major component parts of the communications system in accordance with a preferred embodiment of the present invention.

Referring to FIG. 2, a wayside communications unit (WCU) 200 is shown electrically coupled to the wayside system 100 and in digital radio communication with the HOT unit 132 in accordance with a preferred embodiment of the present invention. The WCU 200 is shown electrically coupled to the wayside system 100 of the prior art, preferably with a bi-directional serial cable 202, such as an RS-232 connector, for instance, thereby to relay data therethrough in the manner known in the art. In a preferred embodiment, port settings for the serial port cable 202 are 9600 baud, 8 bits per character, no parity. In another preferred embodiment, port settings of the serial port cable 202 are 1200 baud, 8 bits per character, even parity. One skilled in the art will recognize the port settings and hardware that are required for the WCU 200 to be compatible with varying embodiments of the wayside system 100.

The WCU 200 includes a microprocessor control circuit 204, and a nonvolatile memory 206 which stores the control program for the microprocessor control circuit 204. The microprocessor control circuit 204 provides outputs to and receives inputs from a transceiver 212. The transceiver 212 transmits digital information to the transceiver 146 which is also used by the HOT unit for communication with the EOT unit. The transceiver 146 provides inputs to the microprocessor control circuit 140 which formats the inputs for display on the display 150. In accordance with a preferred embodiment of the present invention, the display 150 may be an alphanumeric display, for example. In addition, input to the alarm 152 from the microprocessor control circuit at the time of activating the display 150 with the message processed from the transceiver 146 may be provided by the microprocessor control circuit 140, thereby to alert the operator that a message is being displayed. In a preferred embodiment input to an event data recorder 214 is provided by the microprocessor control circuit at the time of activating the display 150, thereby to record the message displayed at the display 150 for subsequent review and analysis, and to record the interaction of the operator due to the message displayed.

Figure 3:
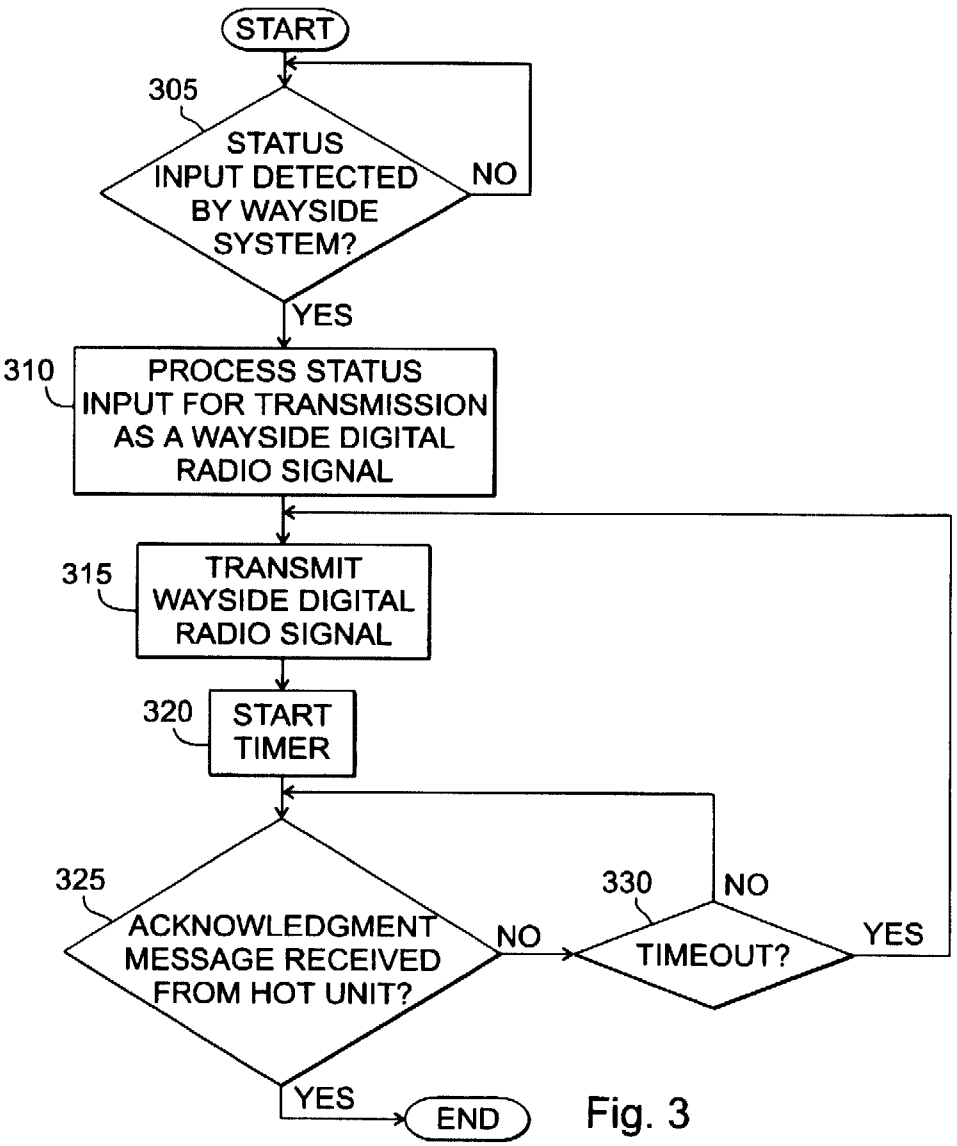
FIG. 3 is a flow diagram showing the logic of the software run by the wayside communications unit microprocessor to provide a method of communication between the wayside communications unit and the locomotive cab, in accordance with a preferred embodiment of the present invention.

FIG. 3 is a flow diagram showing the logic of the software implemented on the WCU microprocessor control circuit 204 to provide a method of communication between the WCU 200 and the locomotive cab 103 in accordance with a preferred embodiment of the present invention. Starting with decision block 305, when a status input is detected by the wayside system 100 and conveyed to the microprocessor control circuit 204, the status input is processed in function block 310 by the microprocessor control circuit 204 for subsequent transmission as a wayside digital radio signal. In function block 315, the processed wayside digital radio signal is transmitted by the transceiver 212, and a software timer is started in function block 320. While the software timer is running, a check is made in decision block 325 to determine if an acknowledgment message has been received by the transceiver 212, thereby to determine if a status message related to the transmitted wayside digital radio signal was displayed by the operator (not shown) in the locomotive cab 103. If the acknowledgment message was received, the process is complete. If the acknowledgment message was not received, a further check is made in decision block 330 to determine if the timer has timed out. If so, the process loops back to function block 315 to re-transmit the processed wayside digital radio signal by the transceiver 212, in the event that the wayside digital radio signal was not previously received by the transceiver 146 at the HOT unit 132. In a preferred embodiment, a software counter may be implemented as known in the art, thereby to return the process to the function block 315 from the decision block 330 only a predetermined number of times. In decision block 330, if the timer has not timed out, then the process loops back to decision block 325.

Figure 4:
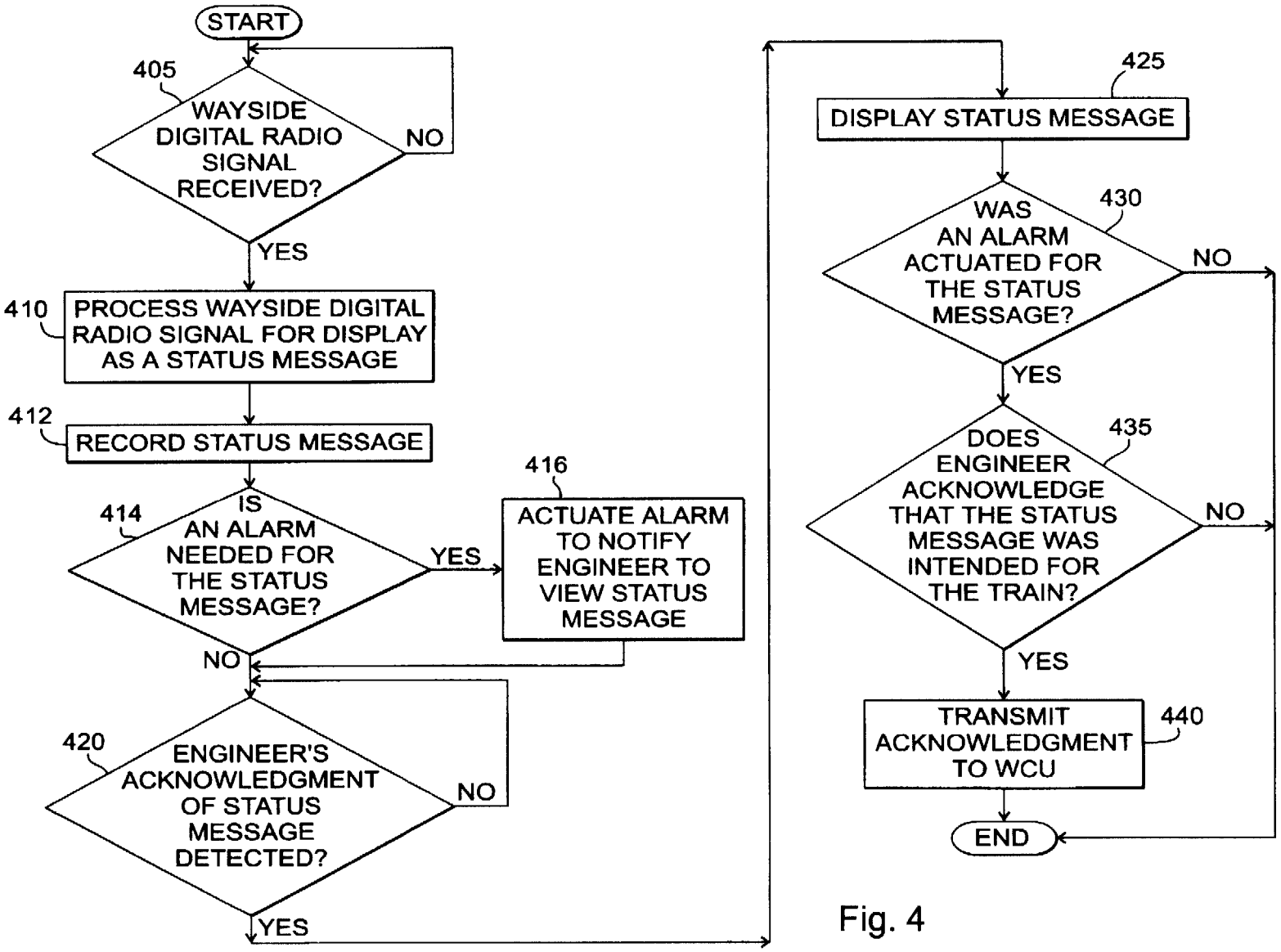
FIG. 4 is a flow diagram showing the logic of the software run by the head-of-train unit microprocessor to provide a method of communication between the wayside communications unit and the locomotive cab, in accordance with a preferred embodiment of the present invention.

FIG. 4 is a flow diagram showing the logic of the software implemented on the HOT microprocessor control circuit 140 to provide a method of communication between the WCU 200 and the locomotive cab 103 in accordance with a preferred embodiment of the present invention. Starting with decision block 405, when the wayside digital radio signal that was transmitted by the transceiver 212 is received by the transceiver 146 at the HOT unit 132, the wayside digital radio signal is processed in function block 410 by the microprocessor control circuit 140 for subsequent display as a status message. In function block 412, the status message is recorded, preferably at the event data recorder 214. In decision block 414, a check is made to determine whether the alarm 152, typically audible or visual, for instance, should be actuated to alert the operator at the locomotive cab 103 that a status message is available for display. If so, in function block 416, the alarm 152 is actuated to notify the operator to view the status message, and then the process proceeds to decision block 420. However, if no alarm is necessary, typically due to lack of relative importance of the status message, the process proceeds directly to decision block 420 from decision block 414.

In decision block 420, a check is made to determine if a status message acknowledgment from the operator was detected, preferably by the operator activating a switch (not shown) at the human interface 142. If not, the process loops back to decision block 420, thereby holding the status message ready for display. In function block 425, when the operator acknowledges the status message, the message is displayed at the display 150. A check is then made in decision block 430 to determine whether the alarm 152 was actuated for the status message. If so, a check is made in decision block 435 to determine whether the operator acknowledges, preferably by the operator activating a switch (not shown) at the human interface 142, that the status message displayed at the display 150 was intended for the locomotive cab 103 that is occupied by the operator. If so, in function block 440, the transceiver 146 transmits the acknowledgment message, preferably as a digital radio signal, that is being anticipated by the WCU 200 in decision block 325 of FIG. 3, and the process ends. In a preferred embodiment, the acknowledgment message is also recorded at the event data recorder 214 in a manner similar to function block 412 wherein the status message was recorded. If the determination in decision block 430 is that the alarm 152 was not actuated for the status message, the process ends with no transmission by the transceiver 146. Similarly, if the determination in decision block 435 is that the operator does not acknowledge that the status message was intended for the operator's locomotive cab 103, the process ends with no transmission by the transceiver 146.

Thus there has been described a system and method of communicating operational status information such as defects sensed by a wayside sensor from a wayside system to a locomotive cab, for display in the head-of-train unit of the locomotive cab, wherein the operational status information is transmitted and acknowledged via digital radio from the wayside system to the HOT unit positioned at the locomotive cab, thereby eliminating the need for synthesized voice transmission of the message via the voice channel VHF radio presently used in the prior art. One skilled in the art will recognize that this system and method of communicating operational status information such as defects sensed by a wayside sensor may also be used for communicating the status of a highway crossing analyzer, which status may then be communicated to a train in advance of the train approaching a highway crossing system that is malfunctioning.

The foregoing description of the preferred embodiment of the present invention has been presented for purposes of illustration and description. It is not intended to be exhaustive or to limit the present invention to the precise form disclosed, and obviously many modifications and variations are possible in light of the above teachings.

The preferred embodiment was chosen and described in order to best explain the principles of the present invention and its practical application to those persons skilled in the art, and thereby to enable those persons skilled in the art to best utilize the present invention in various embodiments and with various modifications as are suited to the particular use contemplated. It is intended that the scope of the present invention be broadly defined by the claims which follow.

What is claimed is:

1. A communication system communicating operational status of a railway wayside to a railway locomotive cab positioned at a head-end of a train, wherein the communication system comprises:

a wayside system located at the railway wayside for sensing a wayside condition of the railway wayside and determining an operational status output signal that characterizes said wayside condition;

a wayside communications unit positioned at said wayside system and electrically coupled to said wayside system, which said wayside communications unit initiates communication with the railway locomotive cab by generating and transmitting a digital transmission signal that is responsive to said operational status output signal, said wayside communications unit comprising first microprocessor means for controlling said wayside communications unit, and transmitting means for transmitting said digital transmission signal to initiate communication with the railway locomotive cab; and a head of train (HOT) unit positioned at the railway locomotive cab, said head of train (HOT) unit comprising first microprocessor means for controlling said HOT unit, receiving means in radio communication with said transmitting means, for receiving said digital transmission signal from said transmitting means, and display means for displaying a message that is responsive to said digital transmission signal, whereby use of voice radio is eliminated for communicating said operational status output signal.

2. The communication system in accordance with claim 1, further comprising:

recording means positioned at the railway locomotive cab, for recording said digital transmission signal.

3. The communication system in accordance with claim 2, further comprising:

alarm means for actuating an alarm at the locomotive cab to notify an operator to view said message.

4. The communication system in accordance with claim 2, wherein said recording means is a railway event data recorder.

5. The communication system in accordance with claim 1, wherein said transmission means is a radio transmitter.

6. The communication system in accordance with claim 5, wherein said receiving means is a radio receiver.

7. The communication system in accordance with claim 1, wherein said transmission means is a first radio transceiver.

8. The communication system in accordance with claim 7, wherein said receiving means is a second radio transceiver.

9. The communication system in accordance with claim 8, wherein said second radio transceiver transmits an acknowledgment signal after said message is displayed, and said first radio transceiver receives said acknowledgment signal.

10. The communication system in accordance with claim 9, wherein said display means is an alphanumeric display.

11. The communication system in accordance with claim 9, wherein said display means is a computer display.

12. The communication system in accordance with claim 9, further comprising means for retransmitting said digital transmission signal at least once for a pre-determined time period unless said acknowledgement signal is received by said first radio transceiver from said second radio transceiver before said pre-determined time period lapses.

13. The communication system in accordance with claim 1, further comprising:

alarm means for actuating an alarm at the locomotive cab to notify an operator to view said message.

14. The communication system in accordance with claim 1, further comprising:

interface means for receiving a control input from an operator.

15. The communication system in accordance with claim 1, wherein said display means is an alphanumeric display.

16. The communication system in accordance with claim 1, wherein said display means is a computer display.

17. The communication system in accordance with claim 1, wherein said voice radio is voice channel Very High Frequency (VHF) radio.

18. A communication system communicating operational status of a railway wayside to a railway vehicle, wherein the communication system comprises:

a wayside system located at the railway wayside for sensing a wayside condition of the railway wayside and determining an operational status output signal that characterizes said wayside condition;

a first communications unit positioned at said wayside system and electrically coupled to said wayside system, which said first communications unit initiates communication with the railway vehicle by generating and transmitting a digital transmission signal that is responsive to said operational status output signal, said first communications unit comprising first microprocessor means for controlling said first communications unit, and transmitting means for transmitting said digital transmission signal to initiate communication with the railway vehicle; and a second communications unit positioned at the railway vehicle, said second communications unit comprising first microprocessor means for controlling said second communications unit, receiving means in communication with said transmitting means, for receiving said digital transmission signal from said transmitting means, and display means for displaying a message that is responsive to said digital transmission signal, whereby use of voice radio is eliminated for communicating said operational status output.

19. The communication system in accordance with claim 18, further comprising:

recording means positioned at the railway vehicle, for recording said digital transmission signal.

20. The communication system in accordance with claim 19, further comprising:

alarm means for actuating an alarm at the railway vehicle to notify an operator to view said message.

21. The communication system in accordance with claim 19, wherein said recording means is a railway event data recorder.

22. The communication system in accordance with claim 18, wherein said transmission means is a radio transmitter.

23. The communication system in accordance with claim 22, wherein said receiving means is a radio receiver.

24. The communication system in accordance with claim 18, wherein said transmission means is a first radio transceiver.

25. The communication system in accordance with claim 24, wherein said receiving means is a second radio transceiver.

26. The communication system in accordance with claim 25, wherein said second radio transceiver transmits an acknowledgment signal after said message is displayed, and said first radio transceiver receives said acknowledgment signal.

27. The communication system in accordance with claim 26, wherein said display means is an alphanumeric display.

28. The communication system in accordance with claim 26, wherein said display means is a computer display.

29. The communication system in accordance with claim 26, further comprising means for retransmitting said digital transmission signal at least once for a pre-determined time period unless said acknowledgement signal is received by said first radio transceiver from said second radio transceiver before said pre-determined time period lapses.

30. The communication system in accordance with claim 18, further comprising:

alarm means for actuating an alarm at the railway vehicle to notify an operator to view said message.

31. The communication system in accordance with claim 18, further comprising:

interface means for receiving a control input from an operator.

32. The communication system in accordance with claim 18, wherein said display means is an alphanumeric display.

33. The communication system in accordance with claim 18, wherein said display means is a computer display.

34. The communication system in accordance with claim 18, wherein said voice radio is voice channel Very High Frequency (VHF) radio.

35. A communication system communicating operational status of a first railway apparatus positioned at a first railway wayside location to a second railway apparatus positioned at a second location which is different than the railway wayside location, wherein the communication system comprises:

a wayside system positioned at the first railway wayside location for sensing a wayside condition of the first railway apparatus and determining an operational status output signal that characterizes said wayside condition;

a first communications unit positioned at the first railway wayside location and electrically coupled to said wayside system, which said first communications unit initiates communication with the second railway apparatus by generating and transmitting a digital transmission signal that is responsive to said operational status output signal, said first communications unit comprising first microprocessor means for controlling said first communications unit, and transmitting means for transmitting said digital transmission signal to initiate communication with the second railway apparatus; and a second communications unit positioned at the second location, said second communications unit comprising first microprocessor means for controlling said second communications unit, receiving means in communication with said transmitting means, for receiving said digital transmission signal from said transmitting means, and display means for displaying a message that is responsive to said digital transmission signal, whereby use of voice radio is eliminated for communicating said operational status output signal.

36. The communication system in accordance with claim 35, further comprising:

recording means positioned at the second location, for recording said digital transmission signal.

37. The communication system in accordance with claim 36, further comprising:

alarm means for actuating an alarm at the second location to notify an operator to view said message.

38. The communication system in accordance with claim 36, wherein said recording means is a railway event data recorder.

39. The communication system in accordance with claim 35, wherein said transmission means is a radio transmitter.

40. The communication system in accordance with claim 34, wherein said receiving means is a radio receiver.

41. The communication system in accordance with claim 35, wherein said transmission means is a first radio transceiver.

42. The communication system in accordance with claim 41, wherein said receiving means is a second radio transceiver.

43. The communication system in accordance with claim 42, wherein said second radio transceiver transmits an acknowledgment signal after said message is displayed, and said first radio transceiver receives said acknowledgment signal.

44. The communication system in accordance with claim 43, wherein said display means is an alphanumeric display.

45. The communication system in accordance with claim 43, wherein said display means is a computer display.

46. The communication system in accordance with claim 43, further comprising means for retransmitting said digital transmission signal at least once for a pre-determined time period unless said acknowledgement signal is received by said first radio transceiver from said second radio transceiver before said pre-determined time period lapses.

47. The communication system in accordance with claim 35, further comprising:

alarm means for actuating an alarm at the second location to notify an operator to view said message.

48. The communication system in accordance with claim 35, further comprising:

interface means for receiving a control input from an operator.

49. The communication system in accordance with claim 38, wherein said display means is an alphanumeric display.

50. The communication system in accordance with claim 35, wherein said display means is a computer display.

51. The communication system in accordance with claim 35, wherein said voice radio is voice channel Very High Frequency (VHF) radio.

52. A system communicating operational status of a railway wayside to a railway locomotive cab positioned at a head-end of a train, wherein the system comprises:

wayside receiving means for receiving at the railway wayside an operational status input signal;

wayside transmission means for transmitting a first digital radio signal from the railway wayside, thereby to initiate communication with the railway locomotive cab, whereby said first digital radio signal characterizes said operational status input signal;

cab receiving means for receiving said first digital radio signal at the locomotive cab, whereby use of voice channel VHF radio is eliminated for communicating said operational status output signal;

cab processing means for providing a status message that characterizes said first digital radio signal received at the locomotive cab, to be viewed by an operator at the locomotive cab; and display means for displaying said status message at the locomotive cab when an acknowledgment of said status message by said operator is detected.

53. The system in accordance with claim 52, further comprising:

alarm means for actuating an alarm to notify said operator to view said status message.

54. The system in accordance with claim 52, further comprising:

recording means for recording at the locomotive cab said status message provided at the locomotive cab.

55. The system in accordance with claim 54, wherein said recording means further records at the locomotive cab said status message provided at the locomotive cab after said operator acknowledges said status message.

56. The system in accordance with claim 52, further comprising:

alarm means for actuating an alarm at the locomotive cab to notify said operator to view said status message;

recording means for recording at the locomotive cab an alarm message characterizing said alarm actuated at the locomotive cab, and for recording said status message provided at the locomotive cab.

57. The system in accordance with claim 56, wherein said recording means further records said status message displayed after said operator acknowledges said status message.

58. The system in accordance with claim 52, further comprising:

cab transmission means for transmitting a second digital radio signal from the locomotive cab, whereby said second digital radio signal characterizes said acknowledgment by said operator of said status message; and wayside receiving means for receiving said second digital radio signal at the wayside system.

59. The system in accordance with claim 58, further comprising means for retransmitting said first digital radio signal at least once for a pre-determined time period unless said second digital radio signal is received by said wayside receiving means from said cab transmission means before said pre-determined time period lapses.

60. The communication system in accordance with claim 52, further comprising:

interface means for receiving a control input from an operator.

61. A communication system communicating operational status of a railway wayside to a railway locomotive cab positioned at a head-end of a train, wherein the communication system comprises:

a head of train unit positioned at the locomotive cab, said head of train unit comprising a first transceiver and a display unit, said head of train unit being controlled by a first microprocessor;

a wayside system, located at the railway wayside, for receiving status inputs sensed at the wayside;

a wayside communications unit positioned at said wayside system and electrically coupled to said wayside system, which said wayside communications unit initiates communication with the railway locomotive cab by generating and transmitting a digital signal that characterizes said status input, said wayside communications unit comprising a second transceiver in radio communication with said first transceiver, and a second microprocessor which controls said second transceiver, wherein said second microprocessor receives data from said wayside system to be transmitted by said second transceiver to said first transceiver for display as a message at said display unit, whereby use of voice radio is eliminated for communicating said status inputs.

62. The communication system in accordance with claim 61, further comprising:

recording means driven by said first microprocessor for recording said message displayed at said display unit.

63. The communication system in accordance with claim 61, further comprising:

interface means at the locomotive cab for receiving a control input from an operator.

64. The communication system in accordance with claim 61, further comprising means for retransmitting said digital signal at least once for a pre-determined time period unless an acknowledgement signal is received by said second transceiver from said first transceiver before said pre-determined time period lapses.

65. The communication system in accordance with claim 61, wherein said voice radio is voice channel Very High Frequency (VHF) radio.

66. A method of communicating operational status of a railway wayside to a railway locomotive cab positioned at a head-end of a train, wherein the method comprises the steps of:

(a) receiving an operational status input signal at a wayside system located at the railway wayside;

(b) transmitting a first digital radio signal from the wayside system, whereby said first digital radio signal characterizes said operational status input signal, thereby to initiate communication with the railway locomotive cab;

(c) receiving said first digital radio signal at the locomotive cab, whereby use of voice radio is eliminated for communicating said operational status output signal;

(d) providing a status message that characterizes said first digital radio signal received at the locomotive cab, to be viewed by an operator at the locomotive cab; and (e) displaying said status message at the locomotive cab when an acknowledgment of said status message by said operator is detected.

67. The method in accordance with claim 66, further comprising the step between steps (d) and (e) of:

(f) actuating an alarm to notify said operator to view said status message.

68. The method in accordance with claim 66, further comprising the step between steps (d) and (e) of:

(f) recording at the locomotive cab said status message provided at the locomotive cab.

69. The method in accordance with claim 68, further comprising the step of:

(g) receiving at the locomotive cab an acknowledgment message from said operator acknowledging said status message.

70. The method in accordance with claim 64, further comprising the step of:

(h) transmitting a second digital radio signal from the locomotive cab, whereby said second digital radio signal characterizes said acknowledgment message.

71. The method in accordance with claim 70, further comprising the step of:

(i) recording at the locomotive cab said operator acknowledging said status message.

72. The method in accordance with claim 70, further comprising the step of:

(i) retransmitting said first digital radio signal for a pre-determined time period unless said second digital radio signal is received at said wayside system from the railway locomotive cab before said pre-determined time period lapses.

73. The method in accordance with claim 66, further comprising the step between steps (d) and (e) of:

(f) actuating an alarm at the locomotive cab to notify said operator to view said status message;

(g) recording at the locomotive cab said alarm actuated at the locomotive cab; and (h) recording at the locomotive cab said status message provided at the locomotive cab.

74. The method in accordance with claim 73, further comprising the step of:

(i) recording said status message displayed after said operator acknowledges said status message.

75. The method in accordance with claim 66, further comprising the steps of:

(f) transmitting a second digital radio signal from the locomotive cab, whereby said second digital radio signal characterizes said acknowledgment by said operator of said status message; and (g) receiving said second digital radio signal at the wayside system.

76. The method in accordance with claim 75, further comprising the step of:

(i) retransmitting said first digital radio signal for a pre-determined time period unless said second digital radio signal is received at said wayside system from the railway locomotive cab before said pre-determined time period lapses.

77. The method in accordance with claim 66, wherein said voice radio is voice channel Very High Frequency (VHF) radio.

* * * * *